US008566970B2

(12) United States Patent
Collignon

(10) Patent No.: US 8,566,970 B2
(45) Date of Patent: Oct. 29, 2013

(54) HYDRAULIC ATUATOR DEVICE FOR RAISING AND LOWERING A SEAT AND LID

(76) Inventor: Carlo Gomez Espana Collignon, Jalisco (MX)

( * ) Notice: Subject to any disclaimer, the term of this patent is extended or adjusted under 35 U.S.C. 154(b) by 52 days.

(21) Appl. No.: 13/394,332

(22) PCT Filed: Sep. 3, 2010

(86) PCT No.: PCT/MX2010/000088
§ 371 (c)(1),
(2), (4) Date: Mar. 5, 2012

(87) PCT Pub. No.: WO2011/028090
PCT Pub. Date: Mar. 10, 2011

(65) Prior Publication Data

US 2013/0160196 A1 Jun. 27, 2013

(30) Foreign Application Priority Data

Sep. 4, 2009 (MX) ..... MX/A/2009/009461

(51) Int. Cl.
*A47K 13/10* (2006.01)

(52) U.S. Cl.
USPC ..... 4/246.2; 4/246.1

(58) Field of Classification Search
USPC ..... 4/246.1–246.3, 667
See application file for complete search history.

(56) References Cited

U.S. PATENT DOCUMENTS 5,029,347 A * 7/1991 Lin ..... 4/246.2
5,279,000 A 1/1994 Mercier et al.
5,604,936 A 2/1997 Mausolf
6,081,936 A 7/2000 Bargman et al.
6,907,621 B2 * 6/2005 Stemen ..... 4/246.1
2013/0007952 A1 * 1/2013 Gomez-Espana Collignon ..... 4/246.2

FOREIGN PATENT DOCUMENTS

| | | |
|---|---|---|
| EP | 0529313 | 3/1993 |
| JP | 4161124 | 6/1992 |
| JP | 2006263112 | 10/2006 |
| WO | WO02062191 | 8/2002 |

* cited by examiner

*Primary Examiner* — Tuan N Nguyen
(74) *Attorney, Agent, or Firm* — Steins & Associates, P.C.

(57) ABSTRACT

Improvements to a hydraulic drive device for raising and lowering the lid and seat of toilettes, characterized by a left and right modules comprising a casing with a central transverse shaft whose ends protrude, each said casing is divided into three recesses; the left shaft end is attached to the lid and the right shaft end to the seat, the opposite end of each shaft being fixed to a drive plate of three flaps, one of each flap housed in each recess of the casing, with each recess also housing a cylindrical diaphragm, which when filled with water press simultaneously against the flaps to cause a partial rotation of the shafts, to raise or lower the lid and seat together or separately by rotary displacement; said diaphragms are fed through a check valve that allows the passage of feed water to fill the diaphragms and to discharge the water from the diaphragms through a duct into the toilet tank when the toilet flush button is actuated; the left and right floor actuation valves are connected to a general water distributor element connected to the water supply duct.

18 Claims, 5 Drawing Sheets

HYDRAULIC ATUATOR DEVICE FOR RAISING AND LOWERING A SEAT AND LID

This application is a continuation in part of application Ser. No. 13/321,526, filed Nov. 18, 2011 ("The Parent Application"), now pending.

FIELD OF THE INVENTION

The present invention generally relates to means and devices used in toilets or lavatories, particularly relates to means used to automatically raise and lower the toilet covering lids using hydraulic power, and more specifically relates to improvements of a hydraulic drive device for raising and lowering the covering lid and seat of the toilet.

BACKGROUND OF THE INVENTION

As is well known, common toilets are shaped in such a way that structurally comprise a bowl consisting of a body with a central hollow round or oblong hole, with an internal trap that discharges into a base fixed to the floor, where the exit of the trap is connected to the sanitary drainage network, said bowl comprises an upper tank where a volume of water is deposited, which is connected through a duct to said bowl, wherein said ducts comprise a ball-cock supply valve with actuating means for discharging water into the bowl.

A water supply duct from a water supply source of a domestic or public supply network connects directly into the water storage upper tank comprising a control bypass valve; wherein said tank includes valve means controlled by a float element to control the water volume to be stored and downloaded to the toilet, so as to dislodge urine and/or feces.

The toilet bowl hole comprises some orifices in the rear portion, where attachment means for a swinging lid and seat that cover the hole are located, the lid and seat are disposed over the hole for hygienic reasons, in order to prevent the user from direct contact with the toilet surface, as well as to provide greater comfort to the user.

The bowl's covering lid consists of a solid body in a similar shape to the hole (round or oblong) and the seat has an annular or elliptical shape that follows the contour of the bowl hole, some seats are also shaped like a horseshoe. Said seat is used so that people sit on it and avoid the direct contact with the bowl surface; in some cases the seat is padded for comfort, while the lid allows the user to cover the bowl hole.

When a female person uses the toilet, she usually tends to lift the lid with her hands or with at least one hand, which can lead to contamination, poor hygiene, etc..

As for a male person, is the traditional problems are well-known, such as when a man who is trying to urinate (if he has a good manners) lifts both the lid and the seat with his hand(s) to avoid splashing the seat with urine and keep the seat clean, with the sanitary implications already indicated due to the direct contact of the hand with the lid and seat, but in many cases men, when the lid is covering the bowl hole, lift only the lid, or if the lid is already lifted, they do not lift the seat, such that when they urinate they splash and wet the seat with urine, causing displeasure in other users of the toilet and causing contamination of the lid that could be a source of infection for other users.

In the prior art, various hydraulic and pneumatic mechanisms and mechanical devices were found that are designed to lift the toilet lid and/or seat, for example PA/a/2001/006808 Mexican patent application to Jaime Barrios Gomez Garibay, of Jul. 2, 2001, which seeks to protect a mechanism for lifting the lid of toilets indirectly and without the use of hands, that comprises a hydraulic system with two plastic valves, one of which is disposed on the floor and the other one of which is disposed below the ring-shaped or horseshoe-shaped lower plastic lid, covering the upper surface of the toilet bowl; both valves being interconnected through a high pressure hose, the valve provided on the floor being of a round pouch shape with convex upper surface, which houses a certain amount of liquid inside; while the valve disposed below the ring-shaped or horseshoe-shaped lower plastic lid is a cylinder with an inner piston or an accordion-type bellows shape.

We found the patent application GB 2376475 (A) to Moran Lynn and Murphy Darly of Dec. 18, 2002, which seeks to protect a mechanism to lift the seat 6 and lid 7, designed to be fitted to standard toilets, which is driven to lift the lid and seat in response to the pressing of a foot-operated pedal 4 surrounding the bottom of the toilet bowl; there is a metal casing 3 which houses the drive mechanism 5 to lift said lid 7 and seat 6, that consists of rods and levers.

We found the utility model PA/u/2005/000273, grant number MX1636 to David Herrera Gurrola, issued on Dec. 18, 2006, which protects a device for raising and lowering a toilet seat, the device generally comprises a rotation shaft placed under the toilet seat and is attached to or makes contact with the same; a lever attached to the rotation shaft and moved by a user so as to transmit its movement to the rotation shaft, which being attached to the seat or making contact with it, achieves the desired motion of ascent or descent of the seat, the rotation shaft that is housed on channels or ducts of the existing hinges formed by the lid, the seat and the toilet hinge brackets or is housed along a housing provided on a support base fixed to the mounting orifices located in the back part of the toilet ring.

We also found Mexican patent application document Pa/a/2006/012503 to Mark Anthony Dercksen and Johannes Gideon Francois Johannes, which seeks the protection of a foot-operated seat lift for a hydraulic toilet that may be easily installed on a toilet; the universal bracket with a retained cylinder and piston is mounted to the toilet bowl using the existing toilet seat fasteners; the toilet seat lift is activated by foot pressure applied to the pedal, which in turn opens a valve to deliver water pressure from the existing toilet water supply to the cylinder and piston.

U.S. Pat. No. 4,291,422 to John J. Shoemaker and Kenneth R. Stark, of Sep. 29, 1981, was also found. This patent discloses a device for raising and lowering the lid and seat members of a toilet comprising a pair of independent hydraulic systems, operatively associated to one of the toilet members (lid or seat). Each hydraulic system includes a manually operable control valve, a hydraulic cylinder having a water inlet/connection port disposed on each of its distal and medium ends that operatively connect the piston rod of the cylinder with the member (lid or seat) associated to the toilet. Each member of the toilet (lid or seat) can be controlled with a hydraulic system associated with a control valve that directs water to one of the ports of the cylinder, while the other port that moves the piston rod in a first direction receives water from the extractor moving the toilet member (lid or seat) rotationally in one direction. In operation, the toilet member lowers the control valve to reverse the cylinder ports that receive and deplete the water that makes the piston rod move in a second direction such that the rotating toilet member is moved on the other direction.

None of the found documents protects or discloses a hydraulic drive device for automatically raising and lowering the toilet covering lid and seat that uses the same fluid source that is used to fill the toilet tank and to dislodge the excreta down the drain, wherein said device is of a simple structure, is easily installed and easily operated, and that can be actuated by sensors or by hand-operated or foot-operated buttons.

Moreover, in the patent application MX/a/2009/005262 to Carlo Gomez Espana Collignon (same inventor and applicant of this application) (the "Parent Application") presents a hydraulic actuating device for raising and lowering the covering lid and seat of a toilet, which is intended to protect a device that can be triggered by sensors and manually pressing pedals with the feet or hands, wherein said device comprises a casing having two adjoining hollow chambers, a left and a right, the cameras house a left rotating shaft and a right rotating shaft, respectively, both shafts fixedly comprise a counterweight that can rotate with the shaft inside the chambers; each chamber also houses an elastic diaphragm (left and right), adjoining and interacting with the counterweights; said diaphragms comprising at least one connecting pivot where a supply duct and/or output of working fluid is connected, so as to drive the counterweights when the chambers are inflated with working fluid supplied by an automatic system or in response to the actuation of contact elements to cause the rotation of said shafts connected to a lid and seat of a toilet, respectively, and which further comprises a left connecting rim and a right connecting rim at the rear of the bowl, each rim having orifices through which are inserted a left fixing bolt and a right one that is fixed at the ends of the rotary shafts with the corresponding counterweights.

A further embodiment of said device is one that comprises a system for the supply of working fluid to the diaphragms with contact elements, comprising a distributor element disposed in the rear of the bowl, directly connected to the main water supply duct into the toilet tank, a first left supply duct and a right supply duct connected to said distributor and left and right valves for actuation with the foot or hand, respectively, arranged on the floor next to the toilet; a second left distribution duct and a second right distribution duct connected from the corresponding left and right foot actuation valves, up to the distributor element in communication with a third left supply duct and a third right supply duct, which emerge from the distributor element and connect to a first upper pivot of the corresponding left and right diaphragms; fourth left and right discharge ducts connected to a second pivot of the corresponding left and right diaphragms, the distributor element for discharging water from said diaphragms, and a main discharge duct connected from the distributor element into the toilet water tank, comprising at its end a valve with a pressure device which opens when the tank is discharged due to the pressure differential, allowing the water to discharge from the system.

It is in this embodiment where the improvement of the present application is focused, seeking to make the operation more efficient, and to reduce the number of elements in the distributor, as well as reducing the number of connections and size of the distributors and actuating elements.

Said device is novel and represents inventive activity, as the same has been designed and developed after substantial testing, development, research, investment of financial resources, personnel and supplies, that have resulted in the device which we believe is novel, because there are not any documents that disclose its existence and neither may be deduced from the combination of information from the found documents, so that it complies with inventive activity.

OBJECTS OF THE INVENTION

The main object of the present invention is to make available some improvements to a hydraulic drive device for raising and lowering the toilet covering lid and seat, so as to avoid wetting the seat with urine when it is used by men to urinate in the toilet.

Another object of the present invention is to enable said improvements to a hydraulic drive device for raising and lowering the toilet covering lid and seat, that also provides greater safety and hygiene to the toilet users.

Other object of the invention is to make available said improvements to a hydraulic drive device for raising and lowering the toilet covering lid and seat, which also avoids the possibility of infection by allowing users to avoid splashing the seat with urine.

Another object of the invention is to make available the above mentioned, that is also structurally simple, easy to manufacture, easy to drive and easy to install.

Another object of the invention is to make available said improvements to a hydraulic drive device for raising and lowering the toilet covering lid and seat that is also structurally more compact and less complex than prior designs.

It is still another object of the invention to make available said improvements to a hydraulic drive device for raising and lowering the toilet covering lid and seat, which also requires fewer connections, and its operation is more efficient, besides it reducing manufacturing costs and the number of elements involved in the operation.

And each of those qualities and objects that will become apparent from a description of the present invention supported on the illustrated embodiments.

SUMMARY OF THE INVENTION

Generally, the improvements to the hydraulic drive device for raising and lowering the toilet covering lid and seat in accordance with the present invention consist of a left module and a right module for driving the toilet lid and seat which are operated hydraulically, said left module being fixed to the lid and the right module being fixed to the toilet seat; said left and right modules being coupled together and fixed to the toilet. Both modules comprise the same shape and consist of a casing which internally comprises three semicircular recesses divided by radial walls at 120 degree angular increments; within said casing is provided a transverse shaft whose ends protrude from the casing; the inner end comprises three grooves within which three flaps of a driving plate are slidably fitted, with one said flap housed in each recess of the casing; each semicircular recess of the casing further houses a cylindrical diaphragm adjoining to each of the flaps, which when filled with water simultaneously push the flaps, which being coupled to the shafts and these to the lid (left shaft) or to the seat (right shaft) lift them or fold them down in its rotary movement.

Each of said diaphragms being connected to an output of a distributor element which is internally housed in a lid of each casing and having the same geometry as said casing and which is fixedly coupled thereto. Said distributor element comprising a back inlet through which water is fed and by means of which connects to the corresponding side output of a check type valve which in turn comprises two lower left and right inlets and a lower central outlet.

An "L" shaped hollow cylindrical bolt that defines a threaded vertical arm with end shank and horizontal arm with end shank, is mechanically connected to each left and right modules and they permit the fixing of the device to the toilet cabinet in the same manner as the conventional seat and lid are fixed.

A water supply duct is fixed in the vertical arm end shank of said bolt , which is connected at its opposite end to a main water distributor disposed behind the toilet where water is fed and a duct portion is connected to the corresponding lower inlet of the check valve in the end shank of the horizontal arm.

A water discharge duct is connected in the lower central outlet of the check valve, which extends to the top of, and is housed within the toilet water tank, and at its end is connected a valve with a pressure sensor device housed inside the tank.

The device is water fed from said main distributor element which is disposed at the back of the bowl and connected at its lower end to the main water supply duct and at the top comprises a second water supply duct to the toilet tank.

The hydraulic drive left module of said device comprises a first left supply duct connected to the distributor element and to a left button or hand- or foot-operable actuation valve, arranged on the floor on the left side of the toilet, which takes water from the main water supply duct; a second left distribution duct connected from the left actuating button to the distributor element and the same supply duct connected from the distributor to the vertical arm end shank of the hollow cylindrical bolt for feeding water to the left module and actuating the lid.

The right module comprises the same piping connection configuration and a hand- or foot-operable right actuation button or valve.

The left module and right module are attached to each other through a lower attaching plate and above which the check valve is provided, which is covered with an arched cap.

The device can operate in two ways: it can raise only the lid by hand- or foot-actuating the left button or valve, or it can raise the seat and lid at the same time by hand- or foot-actuating the right button or valve.

To lift the lid only, it is necessary to press the left button or valve by foot or hand; this allows the water flow from the main supply duct and through the first left supply duct and to continue along the second left duct to the distributor element, to pass through the supply duct connected to the hollow cylindrical bolt of the left module and then to the check valve that lets water pass into the left distributor, which supplies the three diaphragms that are then inflated with water until they press the plate flaps housed in the recesses of the outer casing, which in turn lifts the lid, since it is coupled to the left shaft end and to the lid.

Pressing the water discharge button of the toilet tank, lowering the level, the valve with pressure sensor device housed inside the tank, detects a reduction in pressure and opens to allow the water to empty from the diaphragms by passing through the check valve and coming out by the lower central outlet thereof and further via the duct where said valve with sensor device is connected and discharging the water into the tank.

This operation is performed when the toilet is used for defecation or by female persons when using the toilet to urinate, where lifting the lid is all that is desired.

To lift both the lid and the seat simultaneously, it is necessary to press the right button or valve by foot or hand; this allows the water flow from the main supply duct through the first right supply duct connected to the main distribution and continuing for the second right duct to the main distributor element, to pass through the supply duct connected to the hollow cylindrical bolt of the right module and then to the check valve that lets pass water toward the left and right distributors housed in the left and right casings feeding the three diaphragms in each module, which are inflated with water until they press the plate flaps housed in the recesses of the left and right casings which, being coupled to the end of the left and right shafts, respectively, and these to the lid and the seat, at time, both the lid and the seat are lifted simultaneously.

To lower the lid and the seat, the user need only to simply actuate the flush button of the toilet water tank, and the water dislodge and discharge from the right diaphragms occurs in the same way as discussed above regarding the left diaphragms.

For a better understanding of the invention features, as an integral part thereof, the drawings are attached hereto to illustrate but not limit the present description, as contained below.

Figure 1:
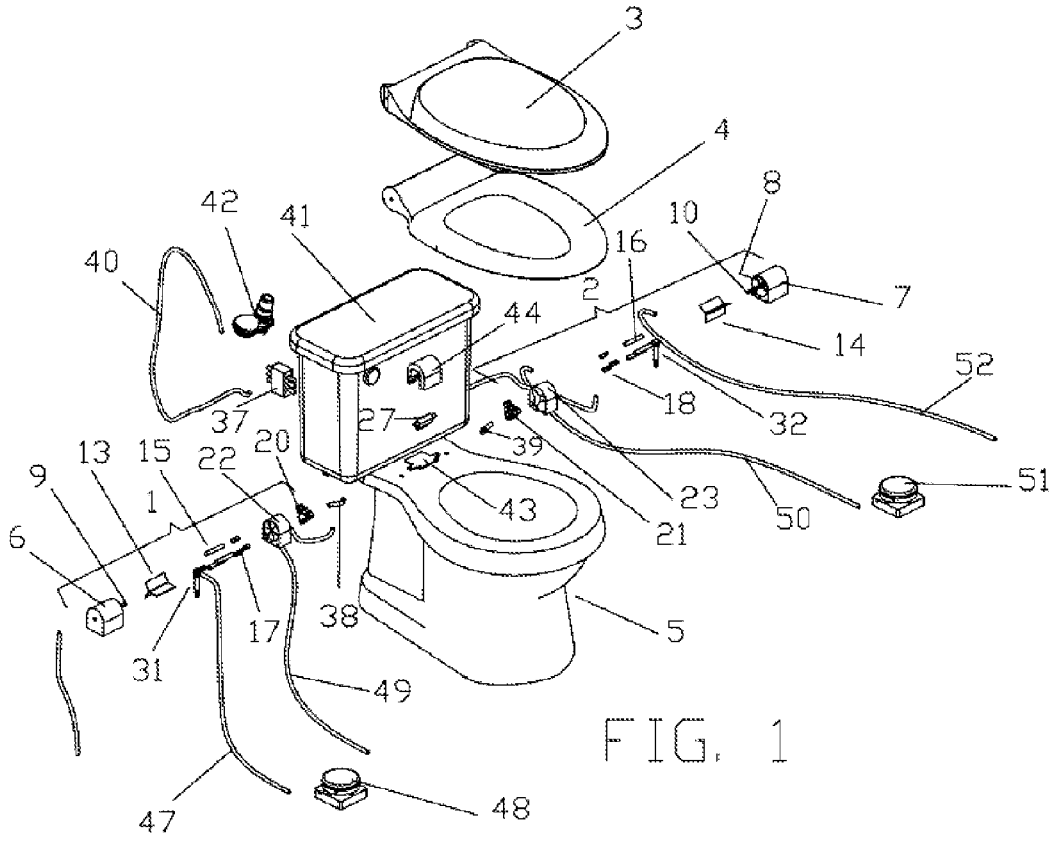
FIG. 1 shows an exploded view of the improved hydraulic drive device for raising and lowering the covering lid and seat of a toilet of the present invention.
Figure 2:
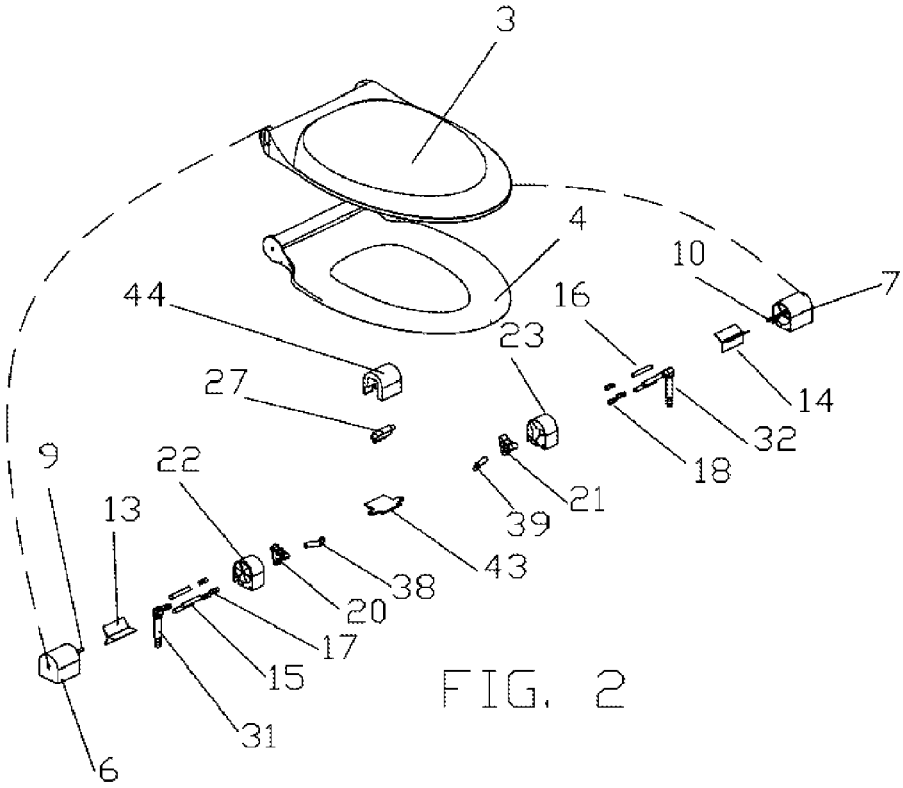
FIG. 2 shows an exploded view of the improved device for the hydraulic drive of raising and lowering the lid and seat of FIG. 1, as well as the lid and seat of the toilet.

For a better understanding of the invention, a detailed description of one of the embodiments of the same shown in the drawings will be made, which for illustrative but not limitative purposes are appended to this description.

DETAILED DESCRIPTION OF THE INVENTION

The characteristic details of the improved hydraulic drive device for raising and lowering the covering lid and a seat of a toilet, is clearly shown in the following description and the appended illustrative drawings, serving the same reference signs to indicate the same parts.

Figure 3:
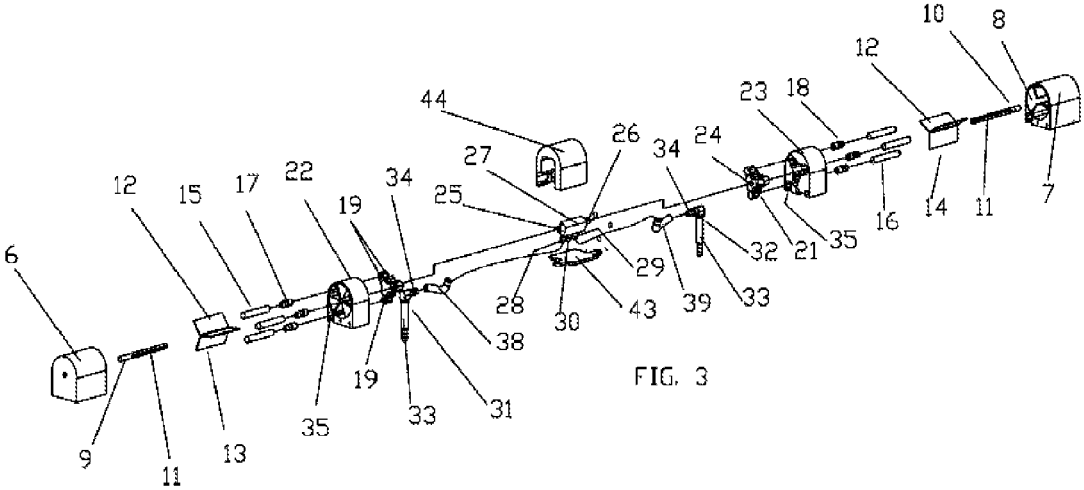
FIG. 3 illustrates an exploded view of the improved hydraulic drive device for raising and lowering the covering lid and seat of a toilet.

Reference is made to FIGS. 1 and 3 showing an exploded view of an improved hydraulic drive device for raising and lowering the covering lid and seat of a toilet, in accordance with the present invention. In said figures, the improved device comprises: a left module 1 and a right module 2 for actuating the lid 3 and the seat 4 of the toilet 5 which are hydraulically operated; said left module 1 being fixed to a lid 3 and the right module 2 being fixed to the seat 4 of the toilet; said left module 1 and right module 2 being coupled together and attached to the toilet 5.

Both modules comprise the same shape and consist of a left casing 6 and a right one 7 comprising internally three semicircular recesses 8 divided by 120-degree radial walls; within said casings is provided a transverse left shaft 9 and right one 10, respectively, whose ends protrude, the inner end comprises three grooves 11 (see FIG. 3) wherein the three flaps 12 of a left drive plate 13 and right one 14 are slidably fitted, such that one of each flap is housed in each recess of the corresponding casings; in each semicircular recess 8 of the casings is housed a cylindrical diaphragm (left 15 and right 16) adjoining to each of the flaps 12, which when filled with water simultaneously press the flaps coupled to the shafts left 9 and right 10 and these to the lid 3 (left shaft 9) and to the seat 4 (right shaft 10) in order lift the lid 3 and seat 4 or fold them down in its rotary movement.

Each of the three left diaphragms 15 and right diaphragms 16, are connected with left connectors 17 and right connectors 18 to an output 19 of a left distributor element 20 and right distributor element 21, respectively, which are internally housed in a left lid 22 and right lid 23 of each casing 6 and 7; these lids have the same geometry as said casings and which are coupled fixedly to them, using various fixing means. Said distributor elements 20 and 21 comprise a back inlet 24 through which water is fed and by which are connected to the corresponding side outlet 25 and 26 of a check type valve 27 that further comprises two lower left inputs 28 and right ones 29 and a lower central outlet 30.

An "L" shaped left hollow cylindrical bolt 31 and a right one 32 which define a threaded vertical arm 33 with end shank and a horizontal arm 34 with end shank, are mechanically connected to each module left 1 and right 2, specifically in a lower notch 35 and the same allow the attachment of the device at the cabinet of the toilet 5 in the same fashion as the conventional lid and seat are fixed.

Figure 4:
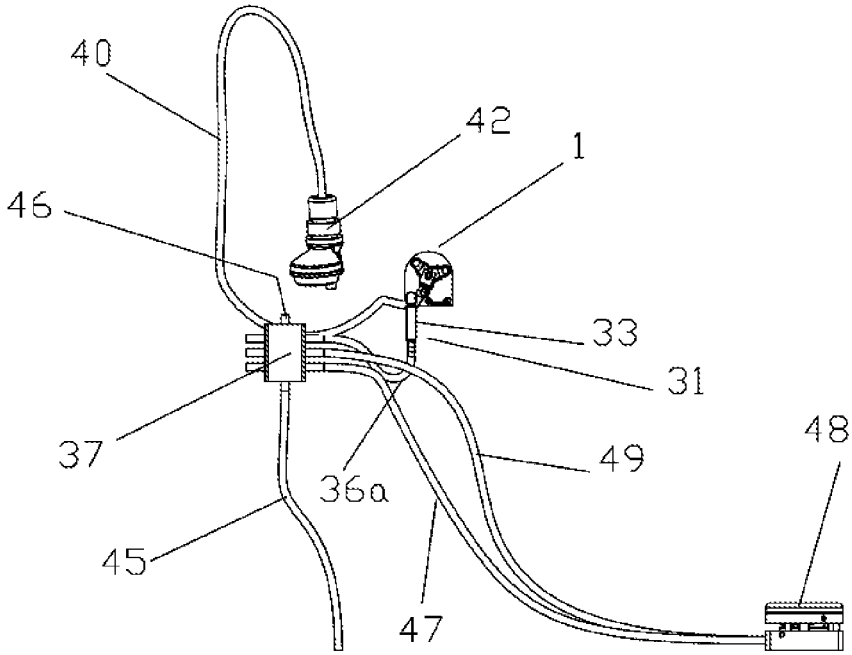
FIG. 4 shows a side perspective view of the left module assembly and connections of the improved hydraulic drive device with the water supply connections from a general distributor into said device and the water discharge into the water tank of the bowl.
Figure 5:
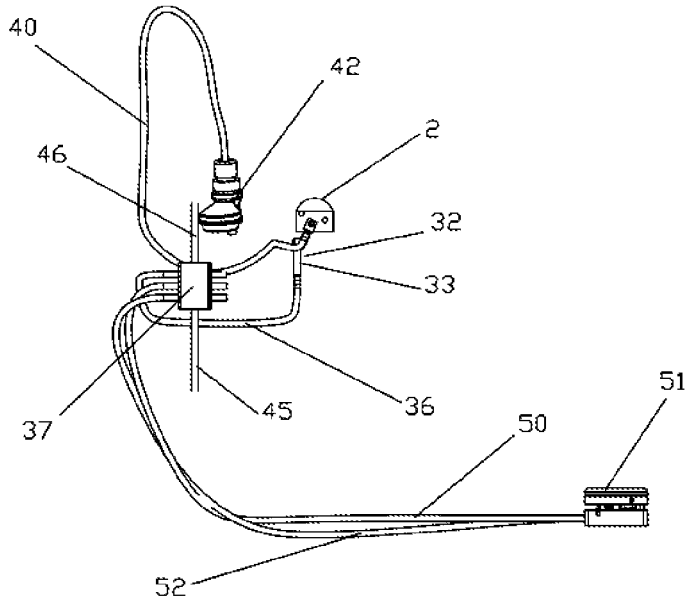
FIG. 5 shows a side perspective view of the right module assembly and connections of the improved hydraulic drive device with the connections of water supply from a general distributor into said device and the water discharge into the water tank of the bowl.

Referring to FIGS. 1, 4 and 5, in the end shank of the vertical arm 33 of said bolts, left bolt 31 and right bolt 32, are fixed to a left water supply duct 36*a* and a right one 36, which is connected at its opposite end to a main water distributor 37 located behind the toilet 5, and through which water is fed, and at the end shank of the horizontal arm 34 left 38 and right 39 duct portion are connected, to the corresponding lower input, left 28 and right 29 of said check valve 27.

At the lower central outlet 30 of the check valve 27 a water discharge duct 40 is connected which extends to the upper part of the water tank 41 of the toilet 5 and is housed within the tank 41 and at its end is connected to a valve with pressure sensor device 42 housed inside the tank 41.

The left module 1 and the right module 2 are each attached through a lower attaching plate 43 and above which the check valve 27 is located, the check valve 27 is covered with an arched cap 44.

Referring to FIGS. 1, 4 and 5, the device is fed water from said main distributor element 37 which is disposed at the back part of the toilet 5 and connected at its lower end to the main water supply duct 45 to the tank 41 of the toilet and at the top comprises a second water supply duct 46 to the tank of the toilet 41.

Figure 6:
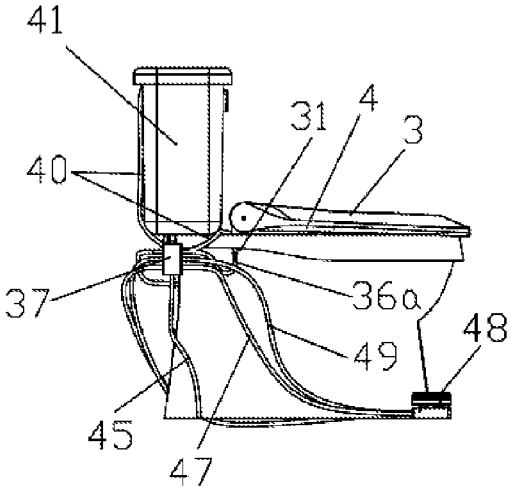
FIG. 6 is a left side view of a toilet with the improved hydraulic drive device for raising and lowering the lid and seat of the toilet installed thereon.

With reference to FIGS. 1, 4 and 6, for the case of a left module 1 of hydraulic operation of said device, comprises a first left supply duct 47 connected to the distributor element 37 and to the left foot- or hand-actuatable actuation valve 48, located on the floor on the left side of the toilet; a second left distribution duct 49 connected from the left actuating valve 48 to the distributor element 37 and the same left water supply duct 36*a* connected from the distributor 37 to the vertical arm end shank 33 of the left hollow cylindrical bolt 31 for feeding water to the left module and actuating the lid 3.

Figure 7:
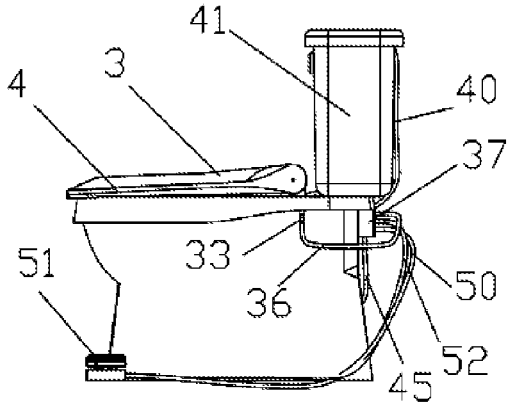
FIG. 7 is a right side view of a toilet with the improved hydraulic drive device for raising and lowering the lid and seat of the toilet installed thereon.

With reference to FIGS. 1, 5 and 7, for the case of a right module 2 of hydraulic operation of said device, comprises a first right supply duct 50 connected to the distributor element 37 and to the right foot- or hand-actuatable actuation valve 51, located on the floor on the left side of the toilet; a second right distribution duct 52 connected from the right actuating valve 51 to the distributor element 37 and the same right water supply duct 36 connected from the distributor 37 to the vertical arm end shank 33 of the right hollow cylindrical bolt 33 for feeding water to the right module and actuating the seat 4.

Figure 8:
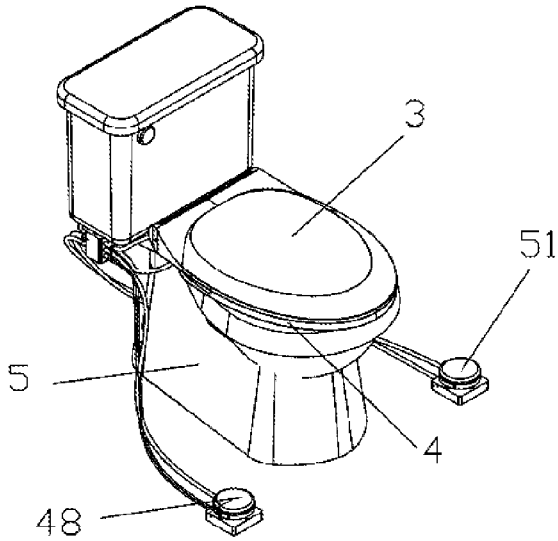
FIG. 8 shows a perspective view of a toilet with the improved hydraulic drive device for raising and lowering the lid and seat of the toilet, with the lid and seat being folded down and covering the toilet hole.
Figure 9:
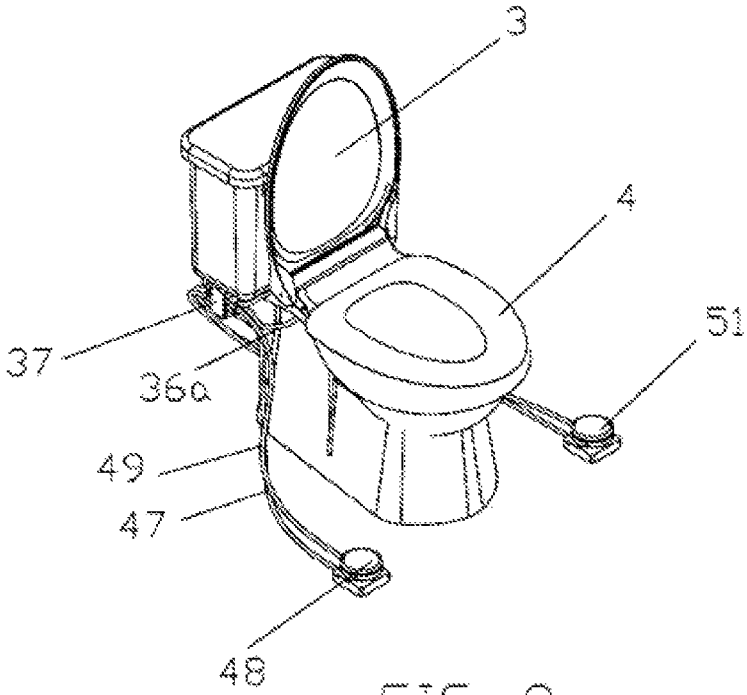
FIG. 9 shows a perspective view of a toilet with the improved hydraulic drive device for raising and lowering the lid and seat of the toilet, with the lid being raised and the seat being down, such as when the left drive valve is actuated by foot or hand.
Figure 10:
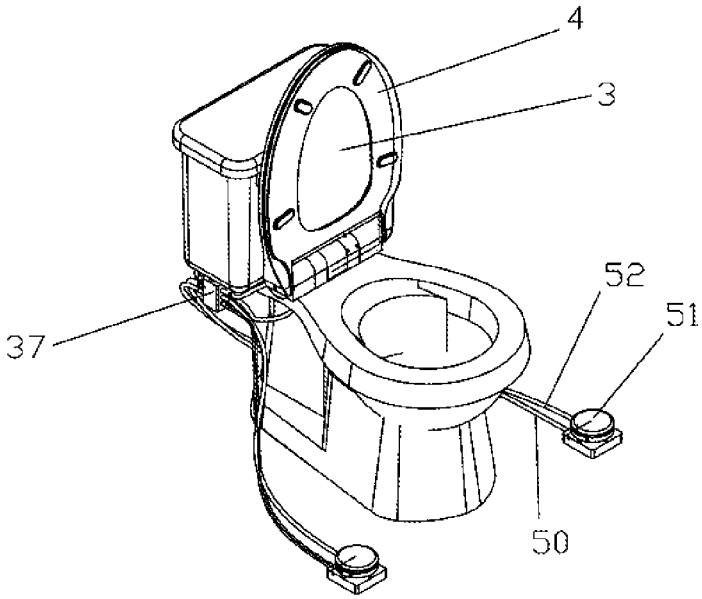
FIG. 10 shows a perspective view of a toilet with the improved hydraulic drive device for raising and lowering the lid and seat of the toilet, with the lid and the seat being raised, when the right drive valve is actuated by foot or hand.

Referring to FIG. 8, depicting the toilet 5 with the improved hydraulic drive device for raising and lowering the lid and seat of a toilet installed, with the lid 3 and seat 4 being folded down covering the hole of the toilet 5, the left valve 48 and right valve 51, disposed on the floor with a separation from the toilet so they can be operated.

With reference to FIG. 9 and FIGS. 1 through 3, 4 and 6, to raise the lid 3 alone, it is necessary to press the left button or valve 48 with the foot or hand, thereby permitting the water flow from the main supply duct through the first left supply duct 47 and continuing through the second left duct 49 towards the distributor element 37 to pass through the supply duct 36*a* connected to the left hollow cylindrical bolt 31 and then to the check valve 27, which lets the water pass on to the left distributor 20 which feeds the three left diaphragm 15, which are inflated with water and consequently press the flaps 12 of the left plate 13 housed in the recesses 8 of the left external casing 6, which being coupled to the left shaft end 9 and the same to the lid 3, in turn lifts the lid 3.

By pressing the water discharge or flush button (not shown) of the toilet tank 41, lowering the water level within the tank, the valve with pressure sensor device 42 housed inside the tank 41, detects a drop in pressure and opens to allows the water to empty from the left diaphragms 15 which pass through the check valve 27 and out through the central lower outlet 30 thereof and through the discharge duct 40 where said valve with sensor device 42, is connected, discharging the water into tank 41. This allows a reverse rotation of the left shaft 9 and thus causes the folded lid to be placed on the seat covering the hole of the toilet 5.

With reference to FIG. 10 and FIGS. 1 to 3, 5 and 7 for lifting the lid 3 with the seat 4, it is necessary to only press the right button/valve 51 with the foot or hand, thereby permitting the water flow from the main supply duct 45 to go through the first right supply duct 50 and continuing through the second right distribution duct 52 to the distributor element 37, to pass through the right supply duct 36 connected to the right hollow cylindrical bolt 32 and then to the check valve 27 which lets the water pass to the distributors, left 20 and right 21 which feed the three diaphragms left 15 and right 16, which inflate with water and press the flaps 12 of the plates, left 13 and right 14 housed in the recesses 8 of the external casing, left 6 and right 7, which being coupled to the end of the corresponding shaft, left 9 and right 10 and these to the lid 3 and to the seat 4, respectively, which in turn lifts both the lid 3 and the seat 4 simultaneously.

By pressing the water discharge button (flush button—not shown) of the toilet tank 41, lowering the level, the valve with pressure sensor device 42 housed inside the tank 41, detects a drop in pressure and opens to allow the emptying of water from the right diaphragms 15 which passes through the check valve 27 out through the central lower outlet 30 thereof and through the discharge duct 40 where said valve with sensor device 42 is connected, discharging the water into the tank 41, this allows reverse rotation of the shaft 10 and the return of the lid and seat to its folded down position to cover the mouth of the toilet 5.

The invention has been described sufficiently to allow a person skilled in the art to reproduce and obtain the results stated in the present invention. However, any person skilled in the technical field of this invention may be able to make modifications not described in this application, however, if for the implementation of such modifications in a determined structure or in the manufacturing process of the same, is required of the matter claimed in the following claims, such structures must be included within the scope of the invention.

What is claimed is:

1. A hydraulic drive device for raising and lowering the covering lid and seat of a toilet, comprising a left module and a right module, said modules attached together, where each said module has the same configuration, said module configuration characterized by:

a casing;

a central transverse shaft contained within said casing, and the end of which protrudes from said case, and wherein each said casing is internally divided into three semicircular cavities;

said left shaft end is attached to the toilet lid and the right shaft end attached to the toilet seat, the opposite end being fixed to a drive plate for three flaps, with one of each said flap being housed in one of each said recess of said casing; in each said recess is also housed a cylindrical diaphragm adjoining each of said flap, whereby when said diaphragms are filled with water, said diaphragms press said flaps simultaneously, thereby causing a partial rotation of said shaft, the left said shaft being coupled to the lid and the right said shaft being coupled to the seat lift the lid and seat together or separately, or said lid and seat together or separately are folded down when said water is discharged from said diaphragms through a check valve; said diaphragms being connected and fed through a check valve adapted firstly to allow the supply water to fill the diaphragms when a respective floor valve located on the floor to the left or right side of the toilet is actuated by hand or foot, and each said check valve adapted secondly to discharge water and empty said diaphragms through a duct into the tank of the toilet when the toilet flush button is actuated for discharge thereof, said left and right valves being connected to a general water supply distributor and said supply distributor being connected to the water supply duct of the supply network that feeds the toilet tank.

2. The hydraulic drive device for raising and lowering the covering lid and seat of a toilet according to claim 1, wherein each of said diaphragms is connected to an output of a distributor element which is internally housed in a lid of each casing and having the same geometry as said casing and which is fixedly coupled to it; said distributor element comprising a back inlet through which water is fed and by means of which is connected to the corresponding side output of said check valve.

3. The hydraulic drive device for raising and lowering the covering lid and seat of a toilet, according to claim 1, wherein said check valve comprises two left and two right lower inputs and a lower central outlet, said left and right lower inputs are connected to the water supply ducts from said main distributor and said lower central outlet duct is connected a water discharging and emptying duct from said diaphragms, said duct extending to the upper part and discharging into the toilet water tank and at its end is connected to a valve having pressure sensor device, said pressure sensor device housed inside the tank, and which allows the water discharge from said diaphragms when said check valve is actuated in response to a pressure differential caused by the drop of the water level when the toilet flushing button is actuated.

4. The hydraulic drive device for raising and lowering the covering lid and seat of a toilet, according to claim 1, further comprising a hollow cylindrical bolt connected to each said left and said right module, each said bolt allowing the attachment of the device to the toilet cabinet; said bolts each connected to a water supply duct from a main water distributor disposed behind the toilet through which water is fed and connected in turn to said corresponding lower input of said check valve.

5. The hydraulic drive device for raising and lowering the covering lid and seat of a toilet, according to claim 1, wherein said main distributor is connected to a lower end of said water supply duct provided in the back of the bowl and said water supply duct further connected to the top of the toilet tank where said supply duct is fed the water that fills the tank.

6. The hydraulic drive device for raising and lowering the covering lid and seat of a toilet, according to claim 4, wherein said hollow cylindrical bolts mechanically connected to each said left and said right module, and which are attached to the lid and the seat on the toilet cabinet, each said bolt defined by an "L" shape that comprises a vertical arm with end shank and a horizontal arm with end shank, and said end shank of said vertical arm of each of said bolts is fixed to the corresponding said left and right water supply duct each of which are connected at their opposite end to said main water distributor disposed behind the toilet and through which water is fed, and the end shank of the horizontal arm is connected to the corresponding portion of duct that is connected to the corresponding lower inlet of said check valve.

7. The hydraulic drive device for raising and lowering the covering lid and seat of a toilet, according to the claim 2, wherein said left module of said device, comprises a first left supply duct connected to said distributor element and to said left side floor valve disposed on the floor at the left side of the toilet; a second left distribution duct connected from said left side floor valve to said distributor element and said left supply duct is connected from said distributor element to said end shank of said vertical arm of said hollow cylindrical bolt for feeding water to said left module.

8. The hydraulic drive device for raising and lowering the covering lid and seat of a toilet, according to the claim 2, wherein said right module of said device, comprises a first right supply duct connected to said distributor element and to said right side floor valve disposed on the floor at the right side of the toilet; a second right distribution duct connected from said right side floor valve to said distributor element and said right supply duct is connected from said distributor element to said end shank of said vertical arm of said hollow cylindrical bolt for feeding water to said right module.

9. The hydraulic drive device for raising and lowering the covering lid and seat of a toilet, according to the claim 1, wherein said left and right modules are attached together through a lower attaching plate and above which said check valve is provided, and further comprising an arched cap covering said check valve.

10. The hydraulic drive device for raising and lowering the covering lid and seat of a toilet, according to claim 9, wherein a user can lift exclusively the lid by pressing said left floor valve by foot or hand such that water will be allowed to flow from said main supply duct through said first left supply duct and continuing through said second left duct into said distributor element, to further pass through said supply duct connected to said left side hollow cylindrical bolt and then to said check valve, said check valve allowing water to pass into said left distributor element that supplies said three diaphragms, which are responsively inflated with water to press said plate flaps housed in said recesses of said outer casing, which in turn lifts the lid.

11. The hydraulic drive device for raising and lowering the covering lid and seat of a toilet, according to claim 10, where a user can lift both the lid and the seat simultaneously by pressing said right floor valve with the foot or hand to allow water to flow from said main supply duct through said first right supply duct connected to said main distribution element and continuing to the second right duct of the main distributor element and to pass through said supply duct connected to said hollow cylindrical bolt of said right module and then to said check valve that lets said water pass toward said left and right distributor elements, housed respectively in said left and right casing and thereby feeding water to said three diaphragms in both said module, which are responsively inflated with water such that they press said plate flaps housed in said recesses of said left and right casings which, being coupled respectively to said left and right shafts, and shafts attached to the lid and the seat, respectively, whereby said shafts turn and the lid and the seat are lifted.

12. The hydraulic drive device for raising and lowering the covering lid and seat of a toilet, according to claim 2, wherein said check valve comprises two left and two right lower inputs and a lower central outlet, said left and right lower inputs are connected to the water supply ducts from said main distributor and said lower central outlet duct is connected a water discharging and emptying duct from said diaphragms, said duct extending to the upper part and discharging into the toilet water tank and at its end is connected to a valve having pressure sensor device, said pressure sensor device housed inside the tank, and which allows the water discharge from said diaphragms when said check valve is actuated in response to a pressure differential caused by the drop of the water level when the toilet flushing button is actuated.

13. The hydraulic drive device for raising and lowering the covering lid and seat of a toilet, according to claim 3, further comprising a hollow cylindrical bolt connected to each said left and said right module, each said bolt allowing the attachment of the device to the toilet cabinet; said bolts each connected to a water supply duct from a main water distributor disposed behind the toilet through which water is fed and connected in turn to said corresponding lower input of said check valve.

14. The hydraulic drive device for raising and lowering the covering lid and seat of a toilet, according to claim 3, wherein said main distributor is connected to a lower end of said water supply duct provided in the back of the bowl and said water supply duct further connected to the top of the toilet tank where said supply duct is fed the water that fills the tank.

15. The hydraulic drive device for raising and lowering the covering lid and seat of a toilet, according to claim 13, wherein said hollow cylindrical bolts mechanically connected to each said left and said right module, and which are attached to the lid and the seat on the toilet cabinet, each said bolt defined by an "L" shape that comprises a vertical arm with end shank and a horizontal arm with end shank, and said end shank of said vertical arm of each of said bolts is fixed to the corresponding said left and right water supply duct each of which are connected at their opposite end to said main water distributor disposed behind the toilet and through which water is fed, and the end shank of the horizontal arm is connected to the corresponding portion of duct that is connected to the corresponding lower inlet of said check valve.

16. The hydraulic drive device for raising and lowering the covering lid and seat of a toilet, according to the claim 3, wherein said left and right modules are attached together through a lower attaching plate and above which said check valve is provided, and further comprising an arched cap covering said check valve.

17. The hydraulic drive device for raising and lowering the covering lid and seat of a toilet, according to claim 16, wherein a user can lift only the lid by pressing said left floor valve by foot or hand such that water will be allowed to flow from said main supply duct through said first left supply duct and continuing through said second left duct into said distributor element, to further pass through said supply duct connected to said left side hollow cylindrical bolt and then to said check valve, said check valve allowing water to pass into said left distributor element that supplies said three diaphragms, which are responsively inflated with water to press said plate flaps housed in said recesses of said outer casing, which in turn lifts the lid.

18. The hydraulic drive device for raising and lowering the covering lid and seat of a toilet, according to claim 17, where a user can lift both the lid and the seat simultaneously by pressing said right floor valve with the foot or hand to allow water to flow from said main supply duct through said first right supply duct connected to said main distribution element and continuing to the second right duct of the main distributor element and to pass through said supply duct connected to said hollow cylindrical bolt of said right module and then to said check valve that lets said water pass toward said left and right distributor elements, housed respectively in said left and right casing and thereby feeding water to said three diaphragms in both said module, which are responsively inflated with water such that they press said plate flaps housed in said recesses of said left and right casings which, being coupled respectively to said left and right shafts, and shafts attached to the lid and the seat, respectively, whereby said shafts turn and the lid and the seat are lifted.

* * * * *